US010787718B2

(12) United States Patent
Larker

(10) Patent No.: US 10,787,718 B2
(45) Date of Patent: Sep. 29, 2020

(54) MATERIAL, METHOD AND COMPONENT

(71) Applicant: Ausferritic AB, Vindeln (SE)

(72) Inventor: Richard Larker, Vindeln (SE)

(73) Assignee: Ausferritic AB (SE)

( * ) Notice: Subject to any disclaimer, the term of this patent is extended or adjusted under 35 U.S.C. 154(b) by 753 days.

(21) Appl. No.: 15/501,643

(22) PCT Filed: Jul. 17, 2015

(86) PCT No.: PCT/SE2015/050826
§ 371 (c)(1),
(2) Date: Feb. 6, 2017

(87) PCT Pub. No.: WO2016/022054
PCT Pub. Date: Feb. 11, 2016

(65) Prior Publication Data

US 2017/0233841 A1 Aug. 17, 2017

(30) Foreign Application Priority Data

Aug. 6, 2014 (EP) ..... 14180077

(51) Int. Cl.

| | |
|---|---|
| ***C21D 1/20*** | (2006.01) |
| ***C21D 6/00*** | (2006.01) |
| ***C22C 38/04*** | (2006.01) |
| ***C22C 38/02*** | (2006.01) |
| ***B21J 1/00*** | (2006.01) |
| ***B22D 11/00*** | (2006.01) |
| ***C21D 5/00*** | (2006.01) |
| ***C21D 9/00*** | (2006.01) |
| ***C22C 33/04*** | (2006.01) |
| ***C22C 37/08*** | (2006.01) |
| ***C22C 37/10*** | (2006.01) |
| ***C22C 38/34*** | (2006.01) |
| ***C22C 38/44*** | (2006.01) |

(52) U.S. Cl.
CPC ..... *C21D 1/20* (2013.01); *B21J 1/003* (2013.01); *B22D 11/001* (2013.01); *C21D 5/00* (2013.01); *C21D 6/004* (2013.01); *C21D 6/005* (2013.01); *C21D 6/008* (2013.01); *C21D 9/0081* (2013.01); *C22C 33/04* (2013.01); *C22C 37/08* (2013.01); *C22C 37/10* (2013.01); *C22C 38/02* (2013.01); *C22C 38/04* (2013.01); *C22C 38/34* (2013.01); *C22C 38/44* (2013.01); *C21D 2211/001* (2013.01); *C21D 2211/002* (2013.01); *C21D 2211/005* (2013.01)

(58) Field of Classification Search
CPC ..... C21D 1/20; C21D 9/0081; C21D 6/005; C21D 6/004; C21D 5/00; C21D 6/008; C21D 2211/005; C21D 2211/001; C21D 2211/002; C22C 38/44; C22C 38/34; C22C 37/10; C22C 37/08; C22C 33/04; C22C 38/04; C22C 38/02; B22D 11/001; B21J 1/003
See application file for complete search history.

(56) References Cited

U.S. PATENT DOCUMENTS

| | | | |
|---|---|---|---|
| 6,203,634 | B1 | 3/2001 | Volkmuth |
| 6,843,867 | B1 | 1/2005 | Foerster et al. |
| 2011/0114229 | A1 | 5/2011 | Perry |

FOREIGN PATENT DOCUMENTS

| | | | |
|---|---|---|---|
| JP | S61174358 | A | 8/1986 |
| JP | S63199847 | A | 8/1988 |
| JP | S63241139 | A | 10/1988 |
| WO | 2008076051 | A1 | 6/2008 |
| WO | 2013/149657 | A1 | 10/2013 |

OTHER PUBLICATIONS

Li, et al., Microstructure and mechanical properties of austempered high silicon cast steel, Materials Science and Engineering A308: 277-282 (2001) (Year: 2001).*
Lee, et al., Internal void closure during the forging of large cast ingots using a simulation approach, Journal of Materials Processing Technology 2011; 211: 1136-1145 (Year: 2011).*
Li, Y., Chen, X. "Microstructure and Mechanical Properties of Austempered High Silicon Cast Steel," Materials Science and Engineering; A, Jun. 30, 2001, vol. 308, Issues 1-2, pp. 277-282.
Krauss, G. Steels: Heat Treatment and Processing Principles, Ohio: ASM International, 2000, p. 267.
International Preliminary Report on Patentability in PCT/SE2015/050826, 5 pages, dated Sep. 30, 2016.
International Search Report in PCT/SE2015/050826 dated Dec. 18, 2015, 5 pages.
Papadimitriou, G. and Cenin, J.M.R., Kinetic and Thermo-dynamic Aspects of the Bainite Reaction in a Silicon Steel, published in Jul. 1983 in vol. 21 (pp. 747-774) of the Materials Research Society Symposia Proceedings.

(Continued)

*Primary Examiner* — Daniel C. McCracken
(74) *Attorney, Agent, or Firm* — Lerner, David, Littenberg, Krumholz & Mentlik, LLP

(57) ABSTRACT

Austempered steel for components requiring high strength and high ductility and/or fracture toughness, which has a silicon content of 3.1 weight-% to 4.4 weight-% and a carbon content of 0.4 weight-% to 0.6 weight-%. The microstructure of the austempered steel is ausferritic or superbainitic.

11 Claims, 1 Drawing Sheet

(56) References Cited

OTHER PUBLICATIONS

Chen, et al., "Effects of Ti , V, and Rare Earth on the Mechanical Properties of Austempered High Silicon Cast Steel," Metallurgical and Materials Transactions; Nov. 2006; pp. 3215-3220, vol. 37A, No. 11, Academic Research Library.

Chen, et al., "Fracture toughness improvement of austempered high silicon steel by titanium, vanadium and rare earth elements modification," Materials Science and Engineering A 444, Jan. 25, 2007, pp. 298-305.

Chen, et al., "Morphology of Retained Austenite and Its Effects on the Mechanical Properties of High Silicon Cast Steel," ACTA Metallurgica Sinica, Mar. 2007, pp. 235-239, vol. 43, No. 3, with English language abstract.

* cited by examiner

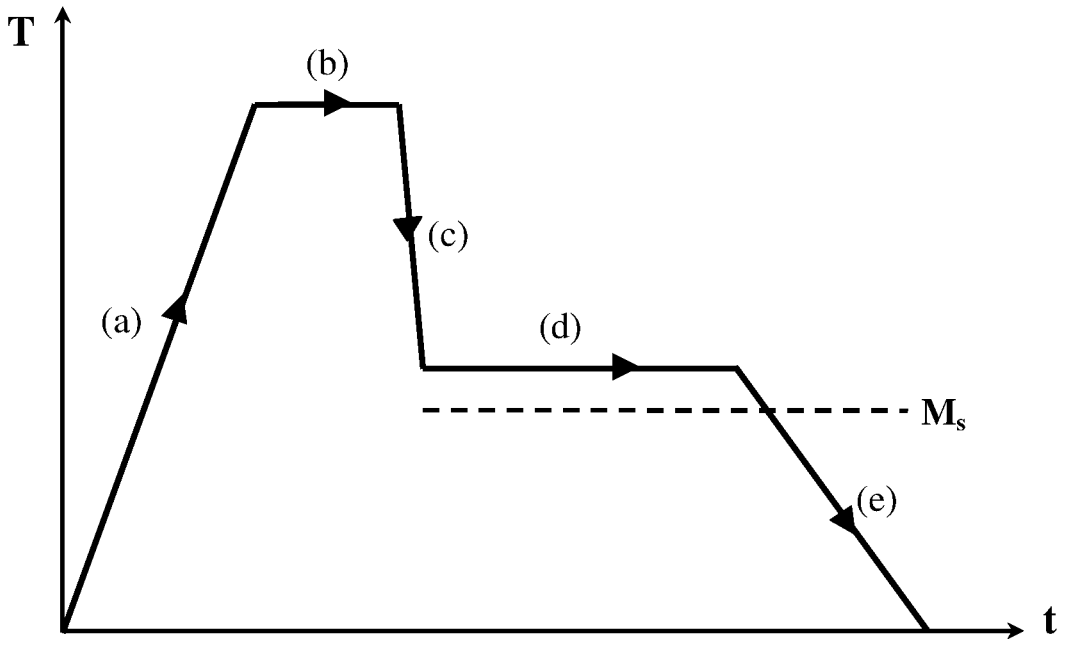
T
(a)
(b)
(c)
(d)
(e)
$M_s$
t

MATERIAL, METHOD AND COMPONENT

CROSS-REFERENCE TO RELATED APPLICATIONS

The present application is a national phase entry under 35 U.S.C. § 371 of International Application No. PCT/SE2015/050826, filed Jul. 17, 2015, which claims priority from EP patent Application No. 14180077.1 filed Aug. 6, 2014, the disclosures of which are incorporated by reference herein.

TECHNICAL FIELD

The present invention concerns an austempered steel intended for components requiring high or very high strength and high or very high ductility and/or fracture toughness, wherein the silicon content in the alloy is increased to prevent bainite formation and promote an ausferritic (also called "superbainitic") microstructure during austempering also when close above the $M_s$ temperature and to increase the solid solution strengthening of the resulting acicular ferrite. The present invention also concerns a method for producing such austempered steel and a component, semi-finished bar or forging comprising such austempered steel, or manufactured using a method according to the present invention.

BACKGROUND OF THE INVENTION

In a typical austempering heat treatment cycle, work pieces comprising steel or cast iron are firstly heated and then held at an austenitizing temperature until they become austenitic and the carbon from dissolved prior cementite in pearlite is evenly distributed in the austenite formed. In steel alloys the carbon content is fixed in prior production steps, while in cast irons the carbon content in the steel-like matrix between the dispersed graphite can be varied by the selection of the austenitization temperature during heat treatment, since the solubility of carbon in austenite increases with temperature and carbon can readily diffuse between matrix and graphite. In cast irons, the austenite must therefore be given enough time to be saturated with carbon diffusing from the graphite.

After the work pieces are fully austenitized, they are quenched (usually in a salt bath) at a quenching rate that is high enough to avoid the formation of pearlite during quenching down to an intermediate temperature below the pearlite region in the continuous cooling transformation (CCT) diagram but above the $M_s$ temperature, at which the austenite having this level of carbon would otherwise start to transform into martensite. This intermediate temperature range is better known as the bainitic range for common low-silicon steels. The work pieces are then held for a time sufficient for isothermal transformation to ausferrite at this temperature called the "austempering" temperature, whereafter they are allowed to cool to room temperature.

In a similar way to the bainitic structures formed by similar heat treatments of low-silicon steels, final microstructure and properties of ausferritic materials are strongly influenced by the austempering temperature and holding time at that temperature. The ausferritic microstructure becomes coarser at higher transformation temperatures and finer at lower temperatures. In contrast to bainitic structures formed in low-silicon steels, nucleation and growth of acicular or feathery ferrite (depending on formation temperature) are generally not accompanied by formation of bainitic carbides, since this is delayed or prevented by the higher silicon content. Instead, the partial diffusion of carbon leaving the ferrite formed enriches the surrounding austenite, stabilizing it by reducing its $M_s$ temperature. The resulting duplex matrix microstructure is named "ausferrite", consisting of acicular or feathery ferrite nucleated and grown in concurrently carbon-stabilized austenite.

At higher isothermal transformation temperatures, the coarser and mainly feathery ferrite is nucleated and grown in a matrix of relatively thick films of carbon-stabilized austenite with a larger relative amount of austenite (promoting higher ductility), while at lower iso-thermal transformation temperatures, the increasingly fine and increasingly acicular ferrite is nucleated and grown in a matrix of relatively thin films of carbon-stabilized austenite with a larger relative amount of ferrite (enabling higher strength).

Austempered ductile iron (ADI) (sometimes erroneously referred to as "bainitic ductile iron" even though when correctly heat treated, ADI contains little or no bainite) represents a special family of ductile (nodular graphite) cast iron alloys which possess improved strength and ductility properties. Compared to as-cast ductile irons, ADI castings are at least twice as strong at the same ductility level, or show at least twice the ductility at the same strength level.

In most cast irons including ductile irons, silicon levels of at least two weight percent in the ternary Fe—C—Si system are necessary to promote grey solidification resulting in graphite inclusions. When austempered, the increased silicon level further delays or completely prevents the formation of embrittling bainite (ferrite+cementite $Fe_3C$) during austempering, as long as the austempering temperature is relatively far above the $M_s$ temperature and the austempering time is not too prolonged. This freedom of bainitic carbides in "upper ausferrite" results in ductile properties (while in low-silicon steels "upper bainite" obtained at similar temperatures is brittle due to the location of its carbides). When austempering of conventional ductile irons is performed at low temperatures, their silicon contents of about 2.3-2.7 weight-% are not sufficient to completely prevent the formation of bainitic carbides in "lower ausferrite". Such microstructures contain fine acicular ferrite as their major phase, thin carbon-stabilized austenite and some bainitic carbide, resulting in decreased ductility, decreased fatigue strength and decreased machinability.

Recently, as-cast ductile iron grades with silicon contents higher than 3 weight-% have been standardized, where their matrices are completely ferritic with increasing solid solution strengthening, providing concurrently increased yield strengths and ductilities compared to conventional ferritic-pearlitic ductile irons of the same ultimate tensile strengths.

Such solution strengthened ductile irons have recently been used as precursors for aus-tempering in development of the SiSSADI® (Silicon Solution Strengthened ADI) concept by the present inventor. In order to obtain complete austenitization, higher temperatures are necessary (since the austenite field in the phase diagram shrinks with increasing silicon); otherwise any remaining proeutectoid ferrite both reduces the hardenability during quench (since nucleation of pearlite in austenite only is slow but growth of pearlite on remaining proeutectoid ferrite is rapid) and reduces the resulting mechanical properties (since less ausferrite can be formed). Benefits from increased silicon include shorter time both during austenitization (since carbon diffusion increases rapidly with temperature) and during austempering (since silicon promotes precipitation of ferrite), increased solution strengthening of the acicular ferrite, freedom of bainitic carbides also in "lower ausferrite" formed close above $M_s$, and as a result concurrently improved strength and ductility.

Ausferritic steels can be obtained by similar heat treatments as for ausferritic irons, on condition that the steels contain sufficient silicon to reduce or prevent the precipitation of bainitic carbides. An example of rolled commercial steels that are suitable for austempering to form ausferrite (without or with low contents of bainitic carbides) instead of bainite is the spring steel EN 1.5026 with a typical composition containing 0.55 weight-% carbon, 1.8 weight-% silicon and 0.8 weight-% manganese. When steels with sufficiently high silicon contents are austempered, they are usually named "superbainite", implying that the major part of the carbon leaving the formed ferrite is enriching and stabilizing the surrounding austenite instead of forming bainitic carbide.

Recent developments in the field of ausferritic (superbainitic) steels have estimated that the carbon content in the ferrite when austempered close above $M_s$ (where very little carbon-stabilized austenite is formed) may reach 0.3 weight-%, a value being much larger than the commonly anticipated equilibrium value of 0.02 weight-%. An additional benefit during austempering from an increased silicon content, besides keeping the carbon within the metallic phases (austenite and ferrite), may be that the local contraction of the ferritic lattice where the smaller silicon atoms substitute the larger iron atoms may concurrently expand some of the interstitial sites situated far from the silicon atoms, thus enabling an increased carbon content in the ferrite. The combined solution strengthening from substitutional silicon and interstitial carbon contributes, together with the fineness of the ausferritic structure and the low content of bainitic carbides, to superior mechanical properties compared to conventionally hardened steels comprising tempered martensite or bainite.

However, prior art in the field of ausferritic (superbainitic) steels has, despite their similarities with ADI, so far rarely covered steels with silicon contents as high as in the solution strengthened ausferritic ductile irons, namely silicon contents above 3 weight-%.

For example, International Publication number WO 2013/149657 discloses a steel alloy having a composition comprising: from 0.6 to 1.0 weight-% carbon, from 0.5 to 2.0 weight-% silicon, from 1.0 to 4.0 weight-% chromium and optionally one or more of the following: from 0 to 0.25 weight-% manganese, from 0 to 0.3 weight-% molybdenum, from 0 to 2.0 weight-% aluminium, from 0 to 3.0 weight-% cobalt, from 0 to 0.25 weight-% vanadium, and the balance iron, together with unavoidable impurities. The microstructure of the steel alloy comprises bainite and, more preferably, superbainite. This document states the following: "The addition of silicon is advantageous because it suppresses the formation of carbides (cementite). If the silicon content is lower than 0.5 weight-%, then cementite may be formed at low temperatures preventing the formation of superbainite. However, too high a silicon content (for example above 2 weight-%) may result in undesirable surface oxides and a poor surface finish. Preferably the steel composition comprises 1.5 to 2.0 weight-% silicon."

There are only two cases found in prior art of austempered steels with silicon contents above 3 weight-%:

The first case used an alloy with a very high carbon content of 0.9 weight-% in combination with 3.85 weight-% silicon. [See the article entitled "Kinetic and Thermo-dynamic Aspects of the Bainite Reaction in a Silicon Steel" by G. Papadimitriou and J. M. R. Cenin, published in 1983 in Volume 21 (pages 747-774) of the Materials Research Society Symposia Proceedings.] Such high carbon content is not beneficial for ausferritic structures since very high contents of both silicon and carbon increases the temperature necessary for complete austenitization (performed at 1130° C. in the article). Further, the precipitation of acicular ferrite is delayed by the very high carbon content and, in spite of the high silicon content, only relatively coarse ausferrite with a large amount of austenite can encompass such carbon content without carbide precipitation.

The second case used three alloys with 1.85, 2.64 or 3.80 weight-% silicon in combination with carbon contents in the range 0.6-0.8 weight-%. [See the article entitled "Microstructure and mechanical properties of austempered high silicon cast steel" by Yanxiang Li and Xiang Chen, published in 2001 in Volume A308 (pages 277-282) of Materials Science and Engineering A.] However, for all three alloys the same austenitization temperature of 900° C. was used, causing incomplete austenitization of the 3.80 weight-% silicon sample and a large amount of proeutectoid ferrite in the microstructure, thereby reducing the amount of ausferrite formed and the resulting mechanical properties. As in the first case, the high carbon content caused similar drawbacks in the second case.

SUMMARY OF THE INVENTION

An object of the present invention is to provide a new kind of austempered steel having an improved combination of high strength and high ductility and/or fracture toughness.

This object is achieved by an austempered steel that has a high silicon content, i.e. a silicon content of 3.1 weight-% to 4.4 weight-% and an intermediate carbon content, i.e. a carbon content of 0.4 weight-% to 0.6 weight-%, i.e. an austempered steel having any suitable chemical composition but with a silicon content of 3.1 weight-% to 4.4 weight-% and a carbon content of 0.4 weight-% to 0.6 weight-%. The microstructure of the austempered steel is ausferritic or superbainitic, i.e. the microstructure of the austempered steel is mainly, if not completely, ausferritic or superbainitic. A mainly ausferritic or superbainitic microstructure is intended to mean that the austempered steel may contain a small amount (5-10%) of martensite. The austempered steel does not however contain any pearlite or pro-eutectoid ferrite.

Such austempered steel may be obtained via an austempering heat treatment including complete austenitization at a temperature of at least 910° C., at least 920° C., at least 930° C., at least 940° C., at least 950° C., at least 960° C. or at least 970° C., whereby the higher the silicon content of the steel, the higher the austenitizing temperature required to achieve complete austenitization.

The inventor has found that ausferritic/superbainitic steels having high silicon contents of 3.1 to 4.4 weight-% and intermediate carbon contents of 0.4 to 0.6 weight-%, when completely austenitized at sufficiently high temperatures (depending on silicon content), have several advantages over prior ausferritic/superbainitic steels (having silicon contents less than 3.0 weight-% and having carbon contents greater than 0.6 weight-%). There are namely improvements in both thermal treatment performance and resulting mechanical properties of the ausferritic/superbainitic steel.

For example, such austempered steels can concurrently exhibit tensile strengths of at least 1800 MPa, fracture elongations of at least 12% and fracture toughness $K_{JIC}$ of at least 150 MPa√m. Due to the promotion by silicon of ferrite precipitation and growth, the time required for austempering is reduced also for austempered steels with an intermediate carbon content of 0.4 weight-% to 0.6 weight-%. Additionally, the high silicon content of 3.1 weight-% to 4.4 weight-% together with the intermediate carbon content of 0.4 weight-% to 0.6 weight-% will ensure that carbide precipitation can be avoided, not only in relatively coarse ausferrite (formed at higher austempering temperatures) with a large amount of austenite but also avoided in finer ausferrite (formed at low austempering temperatures close to $M_s$) with a small amount of austenite.

According to an embodiment of the invention the austempered steel has a silicon content of at least 3.2, 3.3, 3.4, 3.5, 3.6, 3.7, 3.8, 3.9 or 4.0 weight-% and/or a carbon content of at least 0.4 or 0.5 weight-%. Additionally or alternatively, the austempered steel that has a maximum silicon content of 4.3, 4.2, 4.1, 4.0, 3.9, 3.8, 3.7, 3.6 or 3.5 weight-% and/or a maximum carbon content of 0.6 or 0.5 weight-%.

According to an embodiment of the invention the austempered steel has the following composition in weight-%:

| | |
|---|---|
| C | 0.4-0.6 |
| Si | 3.1-4.4 |
| Mn | max 4.0 |
| Cr | max 25.0 |
| Cu | max 2.0 |
| Ni | max 20.0 |
| Al | max 2.0 |
| Mo | max 6.0 |
| V | max 0.5 |
| Nb | max 0.2 |

balance Fe and normally occurring impurities. Phosphorous and sulphur are preferably kept to a minimum.

The word "max" throughout this document is intended to mean that the steel comprises from 0 weight-% (i.e. including 0 weight-%) up to the indicated maximum amount of the element in question. Austempered steel according to the present invention may therefore comprise low levels of such elements when not needed for hardenability or other reasons, i.e. levels of 0 to 0.1 weight-%. Austempered steel according to the present invention may however comprise higher levels of at least one or any number of these elements for optimizing the process and/or final properties, i.e. levels including the indicated max amount or levels approaching the indicated max amount to within 0.1, 0.2 or 0.3 weight-%.

The ausferritic/superbainitic structure is well known and can be determined by conventional microstructural characterization techniques such as, for example, at least one of the following: optical microscopy, transmission electron microscopy (TEM), scanning electron microscopy (SEM), Atom Probe Field Ion Microscopy (AP-FIM), and X-ray diffraction.

According to a further embodiment of the invention, the austempered steel has a microstructure that is substantially carbide-free or that contains very small volume fractions of carbides, i.e. less than 5 vol-% carbides, less than 2 vol-% carbides or preferably less than 1 vol-% carbides.

According to an embodiment of the present invention the austempered steel according to any of the embodiments is obtainable using a method according to any of the embodiments, i.e. by applying increasing austenitization temperature with increasing silicon content due to the reduction of the austenite field in the phase diagram by increasing silicon.

The present invention also concerns a method for producing austempered steel for components requiring high strength and ductility, i.e. a method for producing an austempered steel according to the present invention. The method comprises the step of producing the austempered steel from an alloy having a silicon content of 3.1 to 4.4 weight-% and a carbon content of 0.4 to 0.6 weight-%. The austempered steel is obtained by austempering heat treatment including complete austenitization at a sufficiently high austenitization temperature, whereby the higher the silicon content of the steel, the higher the austenitization temperature, and the resulting microstructure of the austempered steel is ausferritic or superbainitic.

According to an embodiment of the invention the austempered steel produced by a method according to the present invention has a silicon content of at least 3.2, 3.3, 3.4, 3.5, 3.6, 3.7, 3.8, 3.9 or 4.0 weight-% and/or a carbon content of at least 0.4 or 0.5 weight-%. Additionally or alternatively, the austempered steel that has a maximum silicon content of 4.3, 4.2, 4.1, 4.0, 3.9, 3.8, 3.7, 3.6 or 3.5 weight-% and/or a maximum carbon content of 0.6 or 0.5 weight-%.

According to an embodiment of the invention austempered steel having the following composition in weight-% may be manufactured using a method according to an embodiment of the present invention:

| | |
|---|---|
| C | 0.4-0.6 |
| Si | 3.1-4.4 |
| Mn | max 4.0 |
| Cr | max 25.0 |
| Cu | max 2.0 |
| Ni | max 20.0 |
| Al | max 2.0 |
| Mo | max 6.0 |
| V | max 0.5 |
| Nb | max 0.2 |

balance Fe and normally occurring impurities. Phosphorous and sulphur are preferably kept to a minimum.

According to another embodiment of the invention the method comprises the step of completely austenitizing the steel at a temperature of at least 910° C., at least 920° C., at least 930° C., at least 940° C., at least 950° C., at least 960° C. or at least 970° C., depending on the silicon content, whereby the higher the silicon content of the steel, the higher the austenitization temperature.

According to an embodiment of the invention the method comprises the steps of:

a) forming a melt comprising steel with a silicon content of 3.1 to 4.4 weight-% and a carbon content of 0.4 to 0.6 weight-%;
b) casting from said melt a component or a semi-finished bar;
c) allowing said component or semi-finished bar to be forged before cooling or to cool directly, optionally followed by forging and subsequent cooling;
d) heat treating said cooled component, semi-finished bar or forging at a first temperature and holding said component, semi-finished bar or forging at said temperature for a predetermined time to completely austenitize said component, semi-finished bar or forging, whereby the silicon content of the steel, the higher the austenitization temperature;
e) quenching said heat treated component, semi-finished bar or forging at a quenching rate sufficient to prevent the formation of pearlite during quenching down to an intermediate temperature below the pearlite region in the continuous cooling transformation (CCT) diagram but above the $M_s$ temperature, such as a quenching rate of at least 150° C./min;

f) heat treating the component, semi-finished bar or forging at one or several temperatures above the $M_s$ temperature for predetermined time to austemper said component, semi-finished bar or forging, resulting in an ausferritic or superbainitic steel.

The present invention also concerns a component, semi-finished bar or forging, which comprise austempered steel according to any of the embodiments of the present invention or which are manufactured using a method according to any of the embodiments of the present invention. Such a component, semi-finished bar or forging may be intended for use particularly, but not exclusively, in mining, construction, agriculture, earth moving, manufacturing industries, the railroad industry, the automobile industry, the forestry industry, metal producing, automotive, energy and marine applications, or in any other application which requires concurrently very high levels of tensile strength and ductility and/or fracture toughness and/or increased fatigue strength and/or high wear resistance, such as an application for which neither quenched and tempered martensitic nor austempered bainitic steels have sufficient properties, or in applications in which strict specifications must be met consistently. The austempered steel may for example be used to manufacture components such as springs, fastening elements, gears, gear teeth, splines, high strength steel components, load-bearing structures, armour, and/or components that must be less sensitive to hydrogen embrittlement.

BRIEF DESCRIPTION OF THE DRAWINGS

The present invention will hereinafter be further explained by means of non-limiting examples with reference to the appended figure where;

FIG. 1 schematically shows the austempering heat treatment cycle according to an embodiment of the invention.

DETAILED DESCRIPTION OF EMBODIMENTS

FIG. 1 shows an austempering heat treatment cycle according to an embodiment of the invention. A steel component, semi-finished bar or forging having a silicon content of 3.1 weight-% to 4.4 weight-% and a carbon content of 0.4 weight-% to 0.6 weight-% is heated [step (a)] and held at a sufficiently high austenitizing temperature (depending on silicon content) for a time [step (b)] until the component, semi-finished bar or forging becomes fully austenitic and saturated with carbon. The component, semi-finished bar or forging may for example be used in a suspension or powertrain-related component for use in a heavy goods vehicle, such as a spring hanger, bracket, wheel hub, brake calliper, timing gear, cam, camshaft, annular gear, clutch collar, bearing, or pulley.

According to an embodiment of the invention the method comprises the step of maintaining said austenitization temperature for a period of at least 30 minutes. According to another embodiment of the invention the austenitizing step is carried out in a nitrogen atmosphere, an argon atmosphere or any reducing atmosphere, such as a dissociated ammonia atmosphere to prevent the oxidation of carbon. The austenitizing may be accomplished using a high temperature salt bath, a furnace or a localized method such as flame or induction heating.

After the component, semi-finished bar or forging is austenitized, preferably after the component is fully austenitized, it is quenched at a high quenching rate [step (c)], such as 150° C./min or higher in a quenching medium and held at an austempering temperature above the $M_s$ temperature of the alloy [step (d)] for a predetermined time, such as 30 minutes to two hours depending on section size. The expression "a predetermined time" in this step is intended to mean a time sufficient to produce a matrix of ausferrite/superbainite in the component or at least one part thereof. The austempering step may be accomplished using a salt bath, hot oil or molten lead or tin. The complete heat treatment may be performed under Hot Isostatic Pressing (HIP) conditions in equipment capable of quenching under very high gas pressure.

The austempering treatment is preferably, but not necessarily, isothermal. A multi-step transformation temperature schedule may namely be adopted to tailor the phase fractions and their resulting carbon contents in a component's microstructure and to reduce the processing time by increasing nucleation rate of acicular ferrite at lower temperature and growth at higher temperature.

After austempering, the component, semi-finished bar or forging is cooled to room temperature [step (e)]. The steel component, semi-finished bar or forging may then be used in any application in which it is likely to be subjected to stress, strain, impact and/or wear under a normal operational cycle.

According to an embodiment of the invention the method comprises the step of machining the component, semi-finished bar or forging after it has been cast but before the austenitizing step until the desired tolerances are met. It is namely favourable to carry out as much of the necessary machining of the component, semi-finished bar or forging as possible before the austenitization and austempering steps. Alternatively or additionally, the component, semi-finished bar or forging may be machined after the austempering step, for example, if some particular surface treatment is required. A component, semi-finished bar or forging may for example be finished by machining and/or grinding to the required final dimensions and, optionally, honing, lapping or polishing can then be performed.

According to an embodiment of the invention austempered steel having the following composition in weight-% may be manufactured using a method according to an embodiment of the present invention:

| | |
|---|---|
| C | 0.4-0.6 |
| Si | 3.1-4.4 |
| Mn | max 4.0 |
| Cr | max 25.0 |
| Cu | max 2.0 |
| Ni | max 20.0 |
| Al | max 2.0 |
| Mo | max 6.0 |
| V | max 0.5 |
| Nb | max 0.2 |

balance Fe and normally occurring impurities. Phosphorous and sulphur are preferably kept to a minimum.

It will be appreciated that the austempered steel according to the present invention may contain unavoidable impurities, although, in total, these are unlikely to exceed 0.5 weight-% of the composition, preferably not more than 0.3 weight-% of the composition, and more preferably not more than 0.1 weight-% of the composition. The austempered steel alloy may consist essentially of the recited elements. It will therefore be appreciated that in addition to those elements that are mandatory, other non-specified elements may be present in the composition provided that the essential characteristics of the composition are not substantially affected by their presence.

EXAMPLE

Austempered steel having the following composition in weight-% may be manufactured using a method according to an embodiment of the present invention:

| | |
|---|---|
| C | 0.5 |
| Si | 3.5 |
| Mn | 0.1 |
| Cr | 1.0 |
| Ni | 2.0 |
| Mo | 0.2 |

balance Fe and normally occurring impurities. Phosphorous and sulphur are preferably kept to a minimum.

Such a steel may be austenitized at an austenitizing temperature of 920° C. for half an hour until the steel is fully austenitized. After quenching in a quenching medium, the steel may be austempered at 320° C. for two hours. After isothermal austempering, the component, semi-finished bar or forging may be cooled to room temperature.

An austenitizing temperature greater than 920° C. would have to be used to completely austenitize austempered steel having a silicon content greater than 3.5 weight-% silicon.

Further modifications of the invention within the scope of the claims would be apparent to a skilled person. For example, it should be noted that any feature or method step, or combination of features or method steps, described with reference to a particular embodiment of the present invention may be incorporated into any other embodiment of the present invention.

The invention claimed is:

1. An austempered steel composition for components requiring high strength and high ductility and/or fracture toughness comprising a silicon content of 3.1 weight-% to 4.4 weight-% and a carbon content of 0.4 weight-% to 0.6 weight-%, and a microstructure that is ausferritic or superbainitic, wherein the austempered steel composition is obtained by a means of an austempering heat treatment including complete austenitization, whereby the higher the silicon content of the steel, the higher an austenitization temperature of the austempering heat treatment.

2. An austempered steel composition according to claim 1 comprising:

| | |
|---|---|
| C | 0.4-0.6 weight-% |
| Si | 3.1-4.4 weight-% |
| Mn | max 4.0 weight-% |
| Cr | max 25.0 weight-% |
| Cu | max 2.0 weight-% |
| Ni | max 20.0 weight-% |
| Al | max 2.0 weight-% |
| Mo | max 6.0 weight-% |
| V | max 0.5 weight-% |
| Nb | max 0.2 weight-% |

wherein the remaining weight-% of the austempered steel composition comprises Fe and normally occurring impurities.

3. An austempered steel composition according to claim 1 comprising a microstructure that is substantially carbide-free.

4. An austempered steel composition according to claim 1 comprising a microstructure that contains less than 5 vol-% carbides.

5. An ausferritic steel component according to the austempered steel composition of claim 1.

6. A semi-finished bar comprising ausferritic steel according to the austempered steel composition of claim 1.

7. A forging comprising ausferritic steel according to the austempered steel composition of claim 1.

8. A method for producing an austempered steel composition according to claim 1 comprising austempering heat treatment including complete austenitization, wherein the resulting microstructure of the austempered steel composition is ausferritic or superbainitic.

9. A method according to claim 8, wherein the austempered steel composition comprises:

| | |
|---|---|
| C | 0.4-0.6 weight-% |
| Si | 3.1-4.4 weight-% |
| Mn | max 4.0 weight-% |
| Cr | max 25.0 weight-% |
| Cu | max 2.0 weight-% |
| Ni | max 20.0 weight-% |
| Al | max 2.0 weight-% |
| Mo | max 6.0 weight-% |
| V | max 0.5 weight-% |
| Nb | max 0.2 weight-% |

wherein the remaining weight-% of the austempered steel composition comprises Fe and normally occurring impurities.

10. A method according to claim 8 comprising the steps of:

a) forming a melt comprising steel with a silicon content of 3.1 to 4.4 weight-% and a carbon content of 0.4 to 0.6 weight-%;

b) casting from said melt a component or a semi-finished bar;

c) allowing said component or semi-finished bar to be forged before cooling or to cool directly, optionally followed by forging and subsequent cooling;

d) heat treating said cooled component, semi-finished bar or forging at a first temperature and holding said component, semi-finished bar or forging at said temperature for a predetermined time to completely austenitize said component, semi-finished bar or forging, wherein the higher the silicon content of the steel, the higher the austenitization temperature;

e) quenching said heat treated component, semi-finished bar or forging at a quenching rate sufficient to prevent the formation of pearlite during quenching down to an intermediate temperature below a pearlite region in a continuous cooling transformation (CCT) diagram but above an $M_s$ temperature;

f) heat treating the component, semi-finished bar or forging at one or several temperatures above the $M_s$ temperature for a predetermined time to austemper said component, semi-finished bar or forging, resulting in an ausferritic or superbainitic steel.

11. A method according to claim 10, wherein machining is performed before, after or both before and after the heat treatment performed in steps d-f.

* * * * *